United States Patent [19]

Gilbert et al.

[11] Patent Number: 4,469,173

[45] Date of Patent: Sep. 4, 1984

[54] EXPENDABLE PLUG ASSEMBLY

[75] Inventors: Bruce Gilbert; Robert W. Evans, both of Huntsville, Tex.

[73] Assignee: Hughes Tool Company, Houston, Tex.

[21] Appl. No.: 492,907

[22] Filed: May 9, 1983

[51] Int. Cl.[3] ..... E21B 33/12

[52] U.S. Cl. ..... 166/188

[58] Field of Search ..... 166/133, 135, 182, 188, 166/192, 217, 386; 138/89

[56] References Cited

U.S. PATENT DOCUMENTS

| | | | |
|---|---|---|---|
| 2,963,092 | 12/1960 | Anderson | 166/192 X |
| 3,642,064 | 2/1972 | Rosenthal | 166/134 |
| 4,188,999 | 2/1980 | Amancharla | 166/133 |

*Primary Examiner*—Stephen J. Novosad
*Assistant Examiner*—Timothy David Hovis
*Attorney, Agent, or Firm*—Robert A. Felsman; Charles D. Gunter, Jr.

[57] ABSTRACT

An expendable plug assembly of the type adapted to be received within the bore of a well packer is shown having a shear sleeve and a plug body initially received within the shear sleeve interior. The plug body has a closed end for preventing flow of well fluid through the well packer when the plug body is in place within the shear sleeve. A lock ring is provided for releasably supporting the plug body within the shear sleeve interior. A collet body mounted about the plug body has a collet extension at one end thereof and a plurality of collet fingers at the opposite end thereof. The collet fingers are selectively engagable within the well packer bore to fix the plug assembly within the bore. Shear screws are provided for releasably connecting the collet extension to the shear sleeve. The shear screws are severable by downward movement of the shear sleeve relative to the collet extension. A support sleeve is slidably received adjacent the end of the plug body opposite the closed end and has an upper extent which is adapted to be received between the plug body and the collet fingers to secure the collet fingers within the packer bore when the sleeve is in place on the plug body. Equalizing ports are provided in the plug body and shear sleeve which communicate during the initial stages of the plug expending operation to reduce the piston effect of the plug in the packer bore and to facilitate removal of the plug assembly from the well packer.

7 Claims, 3 Drawing Figures

49
47
51
13
41
17
91
45
55
75
25
27
29
31
35
15
113
69
63
65
11
71
93
97
61
115
79
81
99
107

EXPENDABLE PLUG ASSEMBLY

BACKGROUND OF THE INVENTION

The present invention relates generally to downhole oil well tools and, specifically, to an expendable plug assembly designed for use with a well packer, bridge plug, and the like.

Plug assemblies are typically installed within the bore of a well packer or other apparatus, usually at the lower end thereof, for location within a subterranean well at a predetermined depth. With the plug in place in the well bore, as within a set packer bore, a plurality of production zones can be isolated within the well for selective treatment of one or more of the zones.

When the first or upper zone of the well has been treated and the operator desires to either produce through the packer bore or treat the second or lower zone, a tube string is inserted within the well through the bore of the packer to disengage the plug assembly from the set well packer to thereby expend the plug from the packer bore. The plug assembly is then usually allowed to fall to the bottom of the well.

Prior plug assemblies used in operations of the type described have tended to be complex, expensive and difficult or time consuming to manufacture. Certain of the prior plug designs required that the plug be retrieved to the top of the well and the tubing or production string be reinserted into the well for subsequent treatment or production of additional zones. Other of the prior plug designs failed to balance the pressure differentials existing across the plug assembly so that a piston effect was created making it difficult to expend the plug from the bottom of the set well packer.

There exists a need, therefore, for an expendable plug assembly which is simple in construction and operation and relatively inexpensive to manufacture.

There also exists a need for a plug assembly which can be expended from the bore of a set well packer or other apparatus in a single trip so that the tubing utilized to expend the plug can also be utilized to produce or treat a second and lower zone in the well without the requirement of retrieval of the tubing subsequent to the operation of expending the plug.

There also exists a need for a plug assembly which is pressure balanced during the expending operation to facilitate removal of the plug from the packer bore.

There also exists a need for a plug assembly which can be installed within the packer bore in the field without the necessity of dissassembling the packer so that the packer tolerances are not affected prior to running the tool.

SUMMARY OF THE INVENTION

The expendable plug assembly of the type adapted to be received within the bore of a well packer has a shear sleeve having a generally cylindrical exterior and an interior. A plug body is initially received within the shear sleeve interior. The plug body has a closed end for preventing flow of well fluids through the well packer when the plug body is in place within the shear sleeve. Lock means are provided for releasably supporting the plug body within the shear sleeve interior. A collet body is mounted about the plug body and has a collet extension at one end thereof and a plurality of collet fingers at the opposite end thereof. The collet fingers are selectively engagable within the well packer bore to fix the plug assembly within the bore. Frangible means are provided for releasably connecting the collet extension to the shear sleeve. The frangible means is severable by downward movement of the shear sleeve relative to the collet extension. A sleeve means is provided which is adapted to be slidably received adjacent the end of the plug body opposite the closed end. The sleeve means has an upper extent which is adapted to be received between the plug body and the collet fingers to secure the collet fingers within the packer bore when the sleeve is in place on the plug body.

Preferably, the sleeve means is a removable support sleeve received about the plug body opposite end. The packer bore is preferably provided with a recess for receiving the collet fingers. The recess has a shoulder formed at one end thereof for limiting the travel of the collet fingers in one longitudinal sense and the removable sleeve serves to resist movement of the collet fingers in the opposite longitudinal sense when the sleeve is in place on the plug body. The plug body is provided with a body equalizing port adjacent the closed end thereof which is alignable with a sleeve equalizing port provided in the shear sleeve. The ports are alignable when the frangible means connecting the shear sleeve and the collet extension is severed by downward movement of the shear sleeve relative to the collet extension. The lock means is preferably a lock ring carried on a shoulder formed between the shear sleeve and the collet extension. A portion of the lock ring is received within a groove provided in the exterior of the plug body when the plug body is received within the shear sleeve.

The shear sleeve is movable downwardly with respect to the collet extension and plug body between an extended position in which the body equalizing port is sealed off from the sleeve equalizing port and a collapsed position in which the body equalizing port communicates with the sleeve equalizing port to equalize fluid pressure across the plug assembly. In the extended position, the collet body has an outer sealing surface for sealingly engaging the packer bore and an inner surface for sealingly engaging the plug body exterior to prevent fluid transmission across the plug assembly.

In assembling the expendable plug assembly of the invention, the plug assembly is first inserted into the packer bore until the collet fingers of the plug assembly are received within the packer bore recess, the recess shoulder serving to limit the travel of the collet fingers in an upward longitudinal sense. The support sleeve is then slid over the end of the plug body opposite the closed end with the upper extent of the sleeve being received between the plug body and the collet fingers to secure the collet fingers within the packer bore recess.

To expend the plug, a downward force is applied to the shear sleeve causing the frangible means to shear, thereby aligning the sleeve and body equalizing ports. A downward movement of the shear sleeve from the extended position toward the collapsed position allows the lock ring to pop out into an enlarged diameter of the shear sleeve, thereby allowing the plug body to move downwardly so that the support sleeve is moved out from beneath the collet fingers. As the shear sleeve lower extent contacts the collet body shoulder, the collet fingers are forced down a ramp surface of the packer body recess to release the plug assembly. The plug assembly then falls out the end of the packer bore and down into the well.

Additional objects, features and advantages will be apparent in the written description which follows.

DETAILED DESCRIPTION OF THE INVENTION

Figure 1:
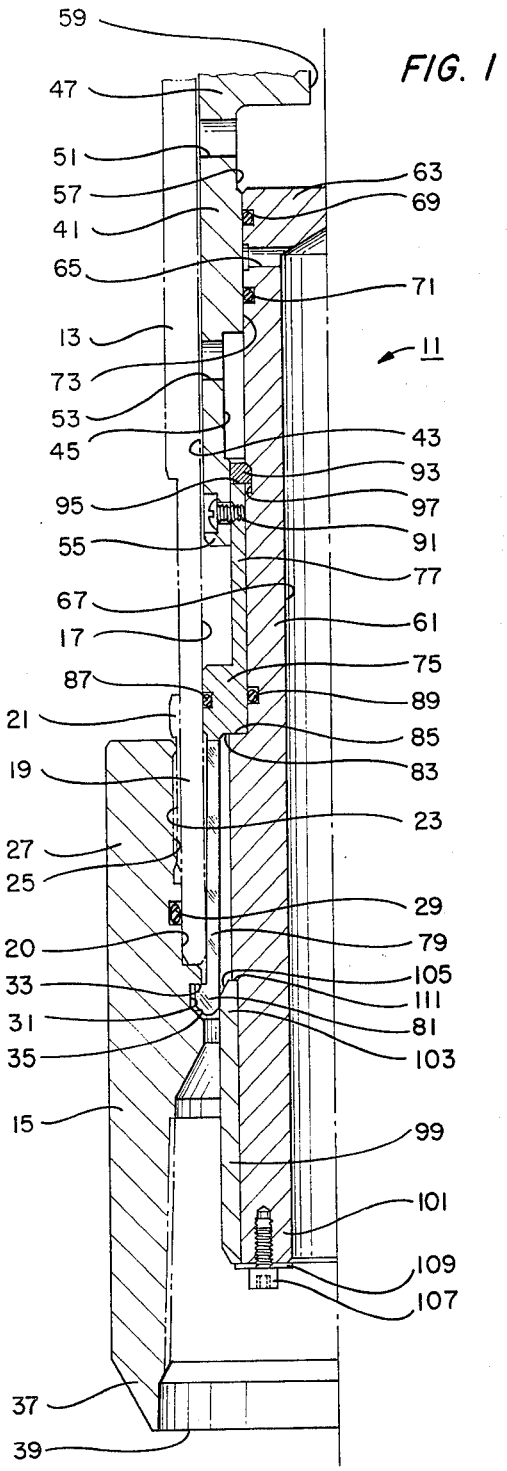
FIG. 1 is a side partial cross-sectional view of the plug assembly of the invention shown locked in position within the bore of a well packer.

Turning now to FIG. 1, there is shown an expendable plug assembly of the invention designated generally as 11. As shown in FIG. 1, the plug assembly 11 is assembled within and run in the bore 17 of a well packer between the packer body 13 shown in dotted lines and a bottom guide 15. Prior to running the packer into the well, the plug assembly 11 is inserted within the bore 17 of the packer and run in place with the packer which is set within the well between upper and lower producing zones. The packer can be any of the conventional tools known in the art which are set within the well by means of expansion and gripping engagement of a slip assembly (not shown) within the interior of the well casing. A conventional elastomeric seal unit (not shown) located on the packer body 13 above the plug assembly 11 is set between the packer 13 and the surrounding well casing to isolate the upper production zone for production or treating operations on that zone.

Figure 2:
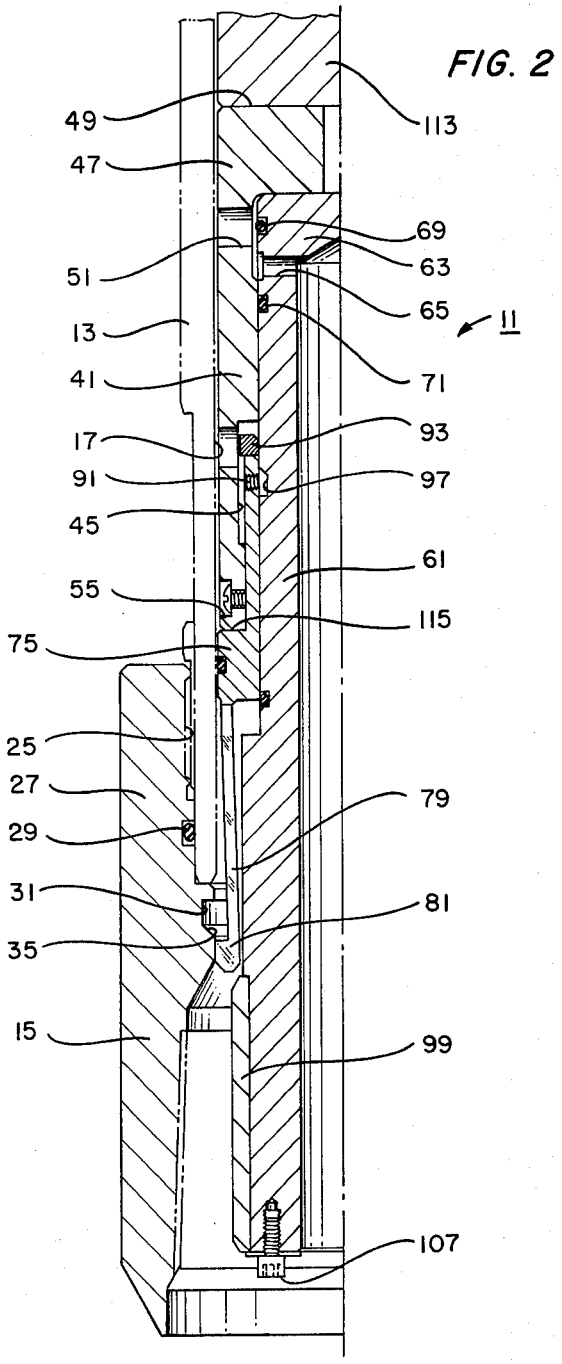
FIG. 2 is a side partial cross-sectional view of the plug assembly of Fig. 1 showing the plug being expended from the packer bore.
Figure 3:
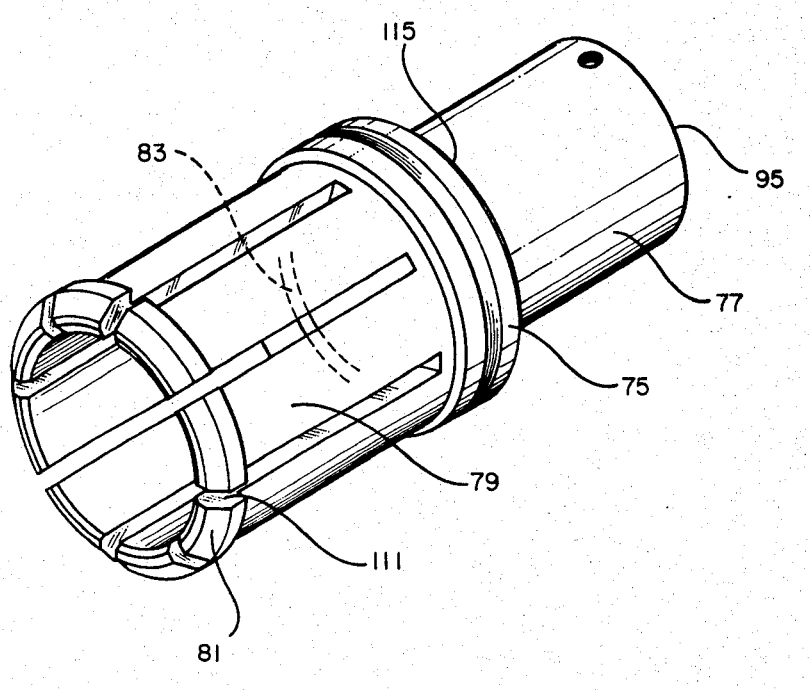
FIG. 3 is a perspective view of the collet body of the plug assembly of FIG. 1.

The well packer is known to those skilled in the art and is shown in dotted lines in FIG. 1 and 2 since it does not form a part of the present invention. The packer body 13 is a tubular conduit which includes a lower extent 19 having an interior bore 17 and which is adapted to engage a bottom guide 15. Any convenient means of engagement can be employed such as by an externally threaded surface 23 adapted to matingly engage the internally threaded surface 25 of the bottom guide upper end 27. The bottom guide 15 is provided with an O-ring 29 received within an O-ring groove located in the interior 20 of the guide 15 for providing sealing engagement with the exterior of the packer body lower extent 19. The bottom guide 15 is provided with a recess 31 in the interior 20 thereof which has a shoulder 33 at one end thereof and which has a downwardly slanting ramp surface 35 at the opposite extent thereof. The bottom guide 15 also has a lower end 37 having an opening 39 therein for receiving the expendable plug assembly 11.

The expendable plug assembly 11 has a shear sleeve 41 having a generally cylindrical exterior 43 and an interior 45. As shown in FIG. 2, the shear sleeve 41 includes an upper end 47 having an outer weight loading surface 49. The shear sleeve 41 has a sleeve pressure equalizing port 51 in the sidewall thereof adjacent the upper end 47 and has a lower vent port 53 in the sidewall thereof adjacent the lower extent 55 thereof. In the position shown in FIG. 1, equalizing port 51 communicates the packer bore 17 with a region 57 within the shear sleeve 55 which communicates within the packer bore 17 above the plug assembly 11 through an opening 59 in the upper end 47. The vent port 53 communicates the interior 45 of the shear sleeve 41 with the packer bore 17.

A plug body 61 is initially slidably received within the shear sleeve interior 45. The plug body 61 is a generally cylindrical member having a closed end 63 for preventing flow of well fluids through the well packer when the plug body 61 is in place within the shear sleeve 41. The plug body 61 has a body equalizing port 65 in the sidewalls thereof adjacent closed end 63. Body equalizing port 65, as seen in FIG. 1, communicates with the interior 67 of the plug body 61 and hence with the region of the well below the plug assembly 11. The body equalizing port 65 is initially sealed off by means of O-rings 69, 71 provided within O-rings grooves in the exterior surface of the plug body 61 which sealingly engage a cylindrical sealing surface 73 within the shear sleeve 41.

A collet body 75 is mounted about the plug body 61 within the packer bore 17 and has a collet extension 77 at one end thereof and a plurality of collet fingers 79 at the opposite end thereof. The collet fingers 79 terminate in dog portions 81 which are selectively engagable within the well packer recess 31 to fix the plug assembly 11 within the packer bore 17. The collet body 75 has an interior shoulder 83 which is adapted to be received upon a mating external shoulder 85 in the plug body 61. An O-ring 87 in an appropriate groove sealingly engages the collet body 75 with the interior packer bore 17 and an O-ring 89 provided in an O-ring groove in the exterior of the plug body 61 provides a fluid seal between the region below the plug assembly 11 and the collet body 75.

The collet extension 77 is a generally cylindrical member which is releasably connected to the shear sleeve 41 by a frangible means such as one or more shear screws 91 provided about the lower extent 55 of the shear sleeve 41.

A lock means is provided for releasably supporting the plug body 61 within the shear sleeve interior 45. The lock means can conveniently be a snap lock ring 93 which is carried on a shoulder 95 formed between the shear sleeve 41 and the collet extension 77 adjacent the shear screws 91. A portion of the lock ring 93 is received within a groove 97 provided in the exterior of the plug body 61 when the plug body is received within the shear sleeve 41 in the position shown in FIG. 1. Snap lock ring 93 is preferably a split metal ring which can be compressed by the lower extent 55 of the shear sleeve 41 to be retained within the groove 97 to prevent downward movement of the plug body 61 relative to the shear sleeve 41 and collet body 75.

A sleeve means such as a removable support sleeve 99 is adapted to be slidably received adjacent the end 101 of the plug body 61 opposite the closed end 63. The sleeve 99 is a generally cylindrical member having an upper extent 103 with an outer tapered end surface 105 which is adapted to be received between the plug body 61 and the collet fingers 79 to secure the collet dog portions 81 within the packer bore recess 31 when the sleeve 99 is in place on the plug body 61 and the plug body 61 is held in the position shown in FIG. 1 by the snap ring 93 engaging groove 97. The support sleeve 99, as shown in FIG. 1, is held in place on the end 101 of plug body 61, as by cap screw 107 and washer 109 which can be removed during the installation of the plug assembly 11 as will be described.

The operation of the expendable plug assembly will now be described. In installing the expendable plug assembly 11 within the bore 17 of a well packer 13, the plug assembly is first inserted into the packer bore 17 at the well surface until the collet fingers 79 and dog portions 81 are received within the recess 31 in the packer bore 17, as shown in FIG. 1. The shoulder 33 of recess 31 limits the travel of the collet fingers 79 in the upward longitudinal sense. The support sleeve 99 is then positioned over the end 101 of the plug body 61 with the outer tapered end surface 105 of the support sleeve 99 passing under the dog portions 81 of the collet fingers 79. The cap screw 107 is then installed to hold the support sleeve 99 in place on the shoulder 111. The removable sleeve 99 thus serves to resist movement of the collet fingers 79 inwardly with respect to the collet body 61 or downwardly with respect to the ramp surface 35 of the recess 31. The packer can now be run into the well bore and set at the desired depth.

The method of expending the plug assembly 11 will now be described. The plug assembly 11 is expended from the bore 17 of the packer 13 by first lowering a tubing string, either plain ended, or with an apparatus such as a mule shoe (113 in FIG. 2) within the bore of the well packer 13 to contact the weight loading surface 49 of the shear sleeve upper end 47. The shear sleeve 41 is movable downwardly with respect to the collet extension 77 and plug body 61 betwen an extended position as shown in FIG. 1 in which the body equalizing port 65 is sealed off from the sleeve equalizing port 51 and a collapsed position, as shown in FIG. 2, in which the body equalizing port 65 communicates with the sleeve equalizing port 51 to equalize fluid pressure across the plug assembly 11. As downward force is applied to the weight loading surface 49 of the shear sleeve 41, the shear screws 91 are severed and shear sleeve 41 moves downwardly to align ports 51 and 65. The design of the shear sleeve is such that there is no differential area available for well pressure differences which may exist across the plug to act on during the downward movement of the shear sleeve. As a result, the only resistance offered to the tubing string during the expending operation is that which results from the force required to shear the shear screws 91. Referring to FIG. 1, it can be seen that any pressure differential which exists within the interior 67 of the plug body is sealed off from the shear sleeve interior 45, for instance, by the O-ring 71. As a result, there is no "piston effect" on the shear sleeve 41 during the expending operation.

Downward movement of the shear sleeve 41 with respect to the collet body 75 and plug body 61 moves the enlarged diameter portion of the shear sleeve interior 45 beneath the snap lock ring 93 allowing the lock ring 93 to pop out of the plug body groove 97, as shown in FIG. 2. The plug body 61 is now free to move downwardly with respect to collet body 75 so that the support sleeve 99 passes out from under the collet fingers 79 and dog portions 81. As the shear sleeve lower extent 55 contacts the collet upper body area (115 in FIG. 2), downward force is applied to the collet body 75 forcing the dog portions 81 of the collet fingers 79 to ride down the ramp surface 35 of the packer bore recess 31 to release the plug assembly 11. The plug assembly is then free to fall out of the packer bore 17 and down the well bore.

An invention has been provided with significant advantages. The expendable plug assembly of the invention is relatively simple in construction and easy to manufacture. The plug assembly can be expended in a single trip operation by contact with the tubing string and does not require retrieval and reinsertion of the tubing or production string. The sleeve equalizing port and body equalizing port are aligned during the initial stage of expending the plug to thereby equalize the fluid pressure above and below the plug assembly to reduce the "piston effect" of the plug assembly and facilitate removal of the assembly from the well packer. By providing the plug assembly with a removable support sleeve, the plug assembly can be installed within the packer bore without removing the packer bottom guide. This allows the packer to be permanently assembled at the factory and the plug assembly 11 to be installed within the bore of the packer in the field at the well surface prior to running the packer into the well bore without disassembling the packer or bottom guide. This feature reduces the possibility of problems in setting the packer within the well bore which are caused by changing the packer tolerances due to removing or partially disassembling the packer in the field.

While the invention has been shown in only one of its forms, it is not thus limited but is susceptible to various changes and modifications without departing from the spirit thereof.

We claim:

1. An expendable plug assembly of the type adapted to be received within the bore of a well packer, comprising:

a shear sleeve having a generally cylindrical exterior and an interior;

a plug body initially received within said shear sleeve interior, said plug body having a closed end for preventing flow of well fluids through said well packer when said plug body is in place within said shear sleeve;

lock means for releasably supporting said plug body within said shear sleeve interior;

a collet body mounted about said plug body having a collet extension at one end thereof and a plurality of collet fingers at the opposite end thereof, said collet fingers being selectively engagable within said well packer bore to fix said plug assembly within said bore;

frangible means for releasably connecting said collet extension to said shear sleeve, said frangible means being severable by downward movement of said shear sleeve relative to said collet extension:

removable sleeve means adapted to be slidably received adjacent the end of said plug body opposite said closed end, said sleeve means having an upper extent adapted to be received between said plug body and said collet fingers to secure said collet fingers within said packer bore when said sleeve is in place on said plug body.

2. The expendable plug of claim 1, wherein said sleeve means is a removable support sleeve received about said plug body opposite end.

3. The expendable plug of claim 2, wherein said packer bore is provided with a recess for receiving said collet fingers, said recess having a shoulder formed at one end thereof for limiting the longitudinal travel of said collet fingers and wherein said removable support sleeve serves to resist inward radial movement of said collet fingers when said sleeve is in place on said plug body.

4. The expendable plug of claim 3, wherein said plug body has a body equalizing port adjacent the closed end thereof and wherein said shear sleeve is provided with a sleeve equalizing port.

5. The expendable plug of claim 4, wherein said lock means is a lock ring carried on a shoulder formed between said shear sleeve and said collet extension, a portion of said lock ring being received within a groove provided in the exterior of said plug body when said plug body is received within said shear sleeve.

6. The expendable plug of claim 5, wherein said shear sleeve is movable downwardly with respect to said collet extension and plug body between an extended position in which said body equalizing port is sealed off from said sleeve equalizing port and a collapsed position in which said body equalizing port communicates with said sleeve equalizing port to equalize fluid pressure across said plug assembly.

7. The expendable plug of claim 6, wherein said collet body has an outer sealing surface for sealingly engaging said packer bore and an inner sealing surface for sealingly engaging said plug body exterior to prevent fluid transmission across said plug assembly.

* * * * *